US012534116B2

(12) United States Patent
Hashimoto et al.

(10) Patent No.: US 12,534,116 B2
(45) Date of Patent: Jan. 27, 2026

(54) MAINTENANCE APPARATUS, MAINTENANCE SYSTEM, AND MAINTENANCE METHOD

(71) Applicant: KYOSAN ELECTRIC MFG. CO., LTD., Yokohama (JP)

(72) Inventors: Naoki Hashimoto, Tokyo (JP); Masakazu Sonobe, Tokyo (JP); Minoru Sano, Yokosuka (JP); Takahiro Kikuno, Yokohama (JP); Yuta Ichikawa, Warabi (JP); Yohei Morimoto, Yokohama (JP)

(73) Assignee: KYOSAN ELECTRIC MFG. CO., LTD., Yokohama (JP)

( * ) Notice: Subject to any disclaimer, the term of this patent is extended or adjusted under 35 U.S.C. 154(b) by 671 days.

(21) Appl. No.: 17/937,579

(22) Filed: Oct. 3, 2022

(65) Prior Publication Data

US 2023/0029300 A1 Jan. 26, 2023

Related U.S. Application Data

(63) Continuation of application No. PCT/JP2021/013566, filed on Mar. 30, 2021.

(30) Foreign Application Priority Data

Apr. 6, 2020 (JP) ..... 2020-068190

(51) Int. Cl.
*B61L 23/04* (2006.01)
*B61L 1/18* (2006.01)

(52) U.S. Cl.
CPC ..... *B61L 23/044* (2013.01); *B61L 1/181* (2013.01)

(58) Field of Classification Search
CPC ..... B61L 1/181; B61L 23/044; B61L 27/53
See application file for complete search history.

(56) References Cited

U.S. PATENT DOCUMENTS 4,770,103 A * 9/1988 Allmer ..... E01B 29/10 104/9
9,121,139 B2 * 9/2015 Delucia ..... E01B 29/32
10,774,478 B2 * 9/2020 Baker ..... B61L 23/047
(Continued)

FOREIGN PATENT DOCUMENTS

EP 1304568 4/2003
EP 3516114 B1 * 9/2020 ..... E01B 29/16
(Continued)

OTHER PUBLICATIONS

The extended European search report of the corresponding EP application No. 21784519.7 mailed Mar. 14, 2024.
(Continued)

*Primary Examiner* — Jason C Smith
(74) *Attorney, Agent, or Firm* — Muncy, Geissler, Olds & Lowe, P.C.

(57) ABSTRACT

A maintenance apparatus (10) transmits a pulse signal from a predetermined observation point (P) of rails (R), observes an observation signal that appears at the observation point (P) after transmission of the pulse signal, compares an observation history of the observation signals and the observation signal received this time, and detects occurrence of abnormality in any one of the rails (R) and at least one electric apparatus (20) connected to the rails (R).

7 Claims, 10 Drawing Sheets

(56) References Cited

U.S. PATENT DOCUMENTS

| | | | | |
|---|---|---|---|---|
| 12,320,247 | B2 * | 6/2025 | Zhao | E21B 47/005 |
| 2006/0257826 | A1 * | 11/2006 | Trapp | G09B 19/16 434/29 |
| 2008/0028972 | A1 * | 2/2008 | Fedorchuk | E01B 27/17 104/2 |
| 2022/0101271 | A1 * | 3/2022 | Steine | G05D 1/6486 |
| 2023/0029300 | A1 * | 1/2023 | Hashimoto | B61L 23/044 |
| 2023/0368155 | A1 * | 11/2023 | Steine | E01B 25/305 |

FOREIGN PATENT DOCUMENTS

| | | | | |
|---|---|---|---|---|
| JP | H0346420 | A | * | 2/1991 |
| JP | H7-245629 | A | | 9/1995 |
| JP | H07245629 | A | * | 9/1995 |
| JP | 2516431 | B2 | * | 7/1996 |
| JP | 2010-59688 | A | | 3/2010 |
| JP | 2010274832 | A | * | 12/2010 |
| JP | 2016068878 | A | * | 5/2016 |

OTHER PUBLICATIONS

International Search Report of PCT/JP2021/013566 mailed Apr. 27, 2021 and English translation thereof.

* cited by examiner

FIG.8

[ELECTRIC APPARATUS CONNECTION TABLE]

202

| APPARATUS ID | CONNECTING POSITION (RELATIVE POSITION) | | OBSERVATION TIME DURATION Δt |
|---|---|---|---|
| | CONNECTING DIRECTION | DISTANCE D | |
| 001 | INBOUND DIRECTION | xxx | X |
| 002 | OUTBOUND DIRECTION | yyy | Y |
| 003 | INBOUND DIRECTION | zzz | Z |
| 004 | INBOUND DIRECTION | www | A |
| ⋮ | ⋮ | ⋮ | ⋮ |

FIG.9

[ABNORMALITY DETECTION TABLE] 204

| SIGNAL LEVEL OF REFLECTED WAVE | SOURCE OF ABNORMALITY | CONTENT OF ABNORMALITY |
|---|---|---|
| NONE | ELECTRIC APPARATUS | OPEN-CIRCUIT FAILURE |
| INCREASED | ELECTRIC APPARATUS | SHORT-CIRCUIT FAILURE, FAILURE ON IMPEDANCE DECREASE SIDE |
| | PART OF RAIL OTHER THAN OBSERVATION POINT | DECREASE OF LEAKAGE CONDUCTANCE |
| DECREASED | ELECTRIC APPARATUS | FAILURE ON IMPEDANCE INCREASE SIDE |
| | PART OF RAIL OTHER THAN OBSERVATION POINT | INCREASE OF LEAKAGE CONDUCTANCE |

FIG.10

210

[OBSERVATION HISTORY DATA]

OBSERVATION ID — 212

PULSE SIGNAL TRANSMISSION TIME — 214

[OBSERVATION SIGNAL WAVEFORM DATA] — 216

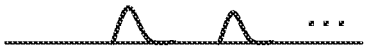

[REFLECTED WAVE DATA] 218

| REFLECTED WAVE ID | OBSERVATION TIME DURATION | SIGNAL LEVEL |
|---|---|---|
| Wa | Δta | Va |
| Wb | Δtb | Vb |
| Wc | Δtc | Vc |
| ⋮ | ⋮ | ⋮ |

[DETECTION RESULT DATA] 220

| REFLECTED WAVE ID | APPARATUS ID | | PRESENCE/ABSENCE OF ABNORMALITY |
|---|---|---|---|
| | INBOUND DIRECTION | OUTBOUND DIRECTION | |
| Wa | 011 | — | WITHOUT ABNORMALITY (NORMAL) |
| Wb | — | 002 | OPEN-CIRCUIT FAILURE |
| Wc | 003 | — | WITHOUT ABNORMALITY (NORMAL) |
| Wd | — | — | RAIL BREAKAGE |
| – (N/A) | 004 | — | RAIL BREAKAGE BETWEEN "003" AND ITSELF |
| ⋮ | ⋮ | ⋮ | ⋮ |

IN TIME SERIES

⋮

MAINTENANCE APPARATUS, MAINTENANCE SYSTEM, AND MAINTENANCE METHOD

CROSS REFERENCE TO RELATED APPLICATION

This application is a continuation of International Patent Application No. PCT/JP2021/013566, having an international filing date of Mar. 30, 2021, which designated the United States, the entirety of which is incorporated herein by reference. Japanese Patent Application No. 2020-068190 filed on Apr. 6, 2020 is also incorporated herein by reference in its entirety.

BACKGROUND

As an example of techniques for detecting rail breakage that is one of abnormalities that occurs in railroad rails, Japanese Unexamined Patent Application Publication No. 2010-59688 discloses a technique to detect the rail breakage when a reflected wave in phase with an incident wave is observed in response to a pulse signal applied to the rails. This is a technique to detect the rail breakage without using a track circuit on a ground side.

By the way, a train control system including installation of a track circuit requires detecting improper dropping of the track circuit. Major factors that cause the improper dropping are an increase of leakage conductance and rail breakage. Moreover, since various electric apparatuses such as an impedance bond are connected to rails in addition to apparatuses related to the track circuit, abnormalities that occur in these electric apparatuses can be the factors of the improper dropping of the track circuit. There are many detection targets of the abnormalities that can be the factors of the improper dropping of the track circuit. However, in consideration of costs required for installation and maintenance, there has been a demand for a technique to specify and detect sources and content of the abnormalities by considering the entire rails and electric apparatuses connected to the rails as the detection target, rather than to exclusively detect a specific abnormality.

BRIEF DESCRIPTION OF THE DRAWINGS

FIG. 8 is an example of an electric apparatus connection table.

FIG. 9 is an example of an abnormality detection table.

FIG. 10 is an example of observation history data.

DESCRIPTION OF EXEMPLARY EMBODIMENTS

Figure 1:
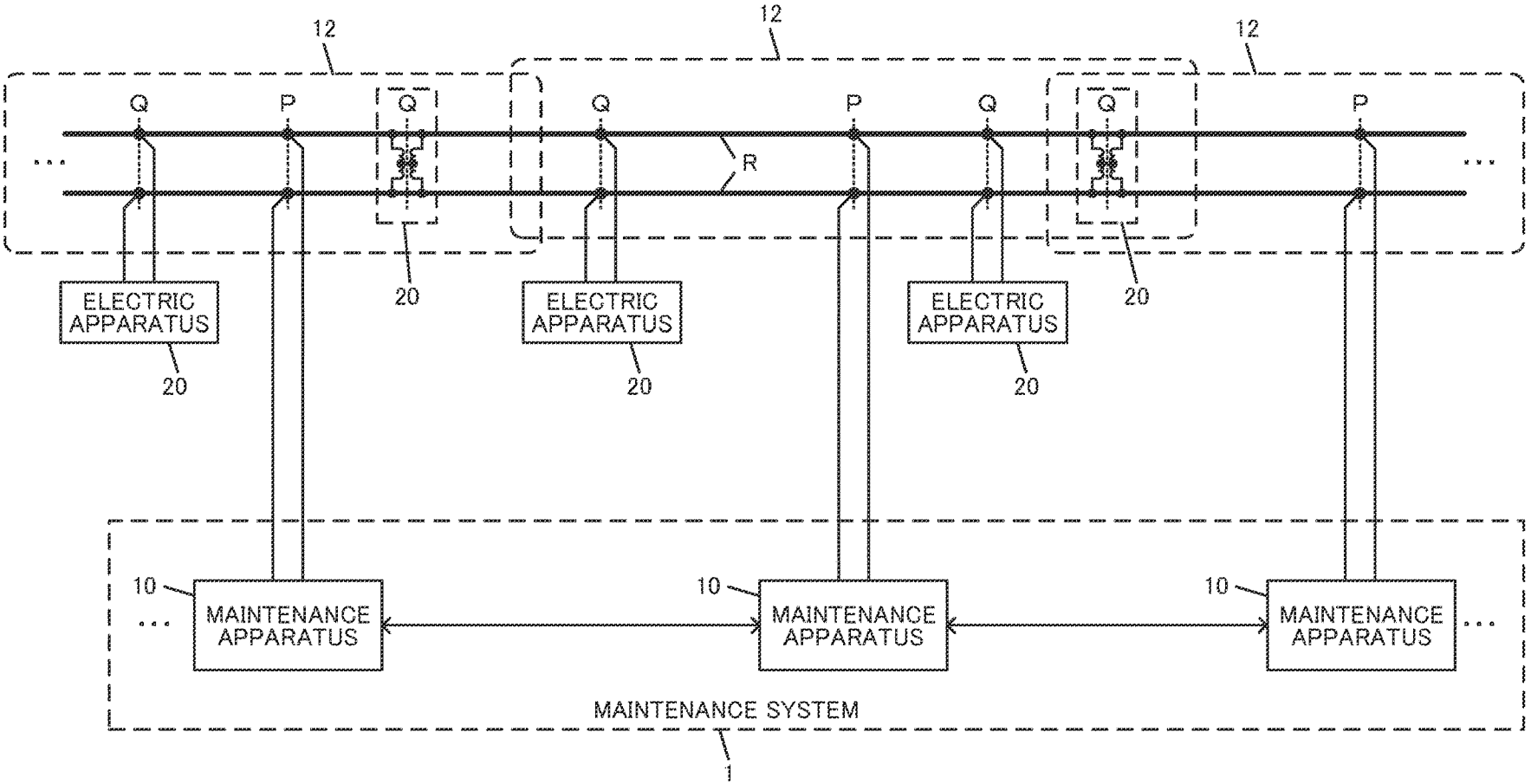
FIG. 1 is an application example of a maintenance system.

The following disclosure provides many different embodiments, or examples, for implementing different features of the provided subject matter. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed. Further, when a first element is described as being "connected" or "coupled" to a second element, such description includes embodiments in which the first and second elements are directly connected or coupled to each other, and also includes embodiments in which the first and second elements are indirectly connected or coupled to each other with one or more other intervening elements in between.

A first aspect is a maintenance apparatus including a transmission control section that transmits a pulse signal from a predetermined observation point of rails of a railroad, an observation section that observes an observation signal that appears at the observation point after transmission of the pulse signal, and a detection section that compares an observation history of the observation signals and the observation signal received this time to detect occurrence of abnormality in any one of the rails and at least one electric apparatus connected to the rails.

Another aspect is a maintenance method that includes transmitting the pulse signal from the predetermined observation point of the rails of the railroad, observing the observation signal that appears at the observation point after the transmission of the pulse signal, and comparing the observation history of the observation signals and the observation signal received this time to detect the occurrence of the abnormality in any one of the rails and the at least one electric apparatus connected to the rails.

As a result, in some embodiments, it is possible to detect the occurrence of the abnormality in any one of the rails and the electric apparatus connected to the rails. That is, when the abnormality occurs in any one of the rails and the electric apparatus connected to the rails, the observation signal can vary. Accordingly, it is possible to detect the occurrence of the abnormality in any one of the rails and the electric apparatus connected to the rails by comparing the observation signal with the observation history of previous observation signals in a normal state of the rails and the electric apparatus connected to the rails, for example.

A second aspect is the maintenance apparatus described above, in which the observation signal includes a reflected wave from a connection point to which the electric apparatus is connected, and the detection section detects the occurrence of abnormality using a signal level of the reflected wave.

As a result, in some embodiments, it is possible to specify where in the rails and the electric apparatus connected to the rails the abnormality occurs. That is, part of the pulse signal transmitted to the rail is reflected at the connection point of the electric apparatus, and part of the signal that is not reflected is continuously propagated. When the abnormality occurs in the electric apparatus connected to the rail, or when the abnormality occurs in at least one of the rails from the observation point to the connection point of the electric apparatus, a reflected signal from the connection point of the electric apparatus can vary. For example, when an open-circuit failure occurs as the abnormality in the electric apparatus that is not connected to an insulating boundary, a load impedance of the connection point of the electric apparatus as seen from the observation point becomes a state corresponding to a characteristic impedance of the rail R, so that the signal level of the reflected wave by this connection point is lost (not observed). Meanwhile, when any other electric apparatus is connected beyond the connection point, a signal level of a reflected wave from a connection point of this electric apparatus increases. Furthermore, when a short-circuit failure in the electric apparatus occurs as the abnormality, the load impedance of the connection point of the electric apparatus as seen from the observation point becomes almost zero, so that the signal level of the reflected wave by this connection point increases compared with a signal level in a steady state. Meanwhile, when any other electric apparatus is connected beyond the connection point, a reflected wave from a connection point of this electric apparatus is lost (not observed). Furthermore, when an increase of leakage conductance in at least one of the rails occurs as the abnormality, signal levels of reflected waves from connection points of all electric apparatuses connected beyond an occurrence place of the abnormality as seen from the observation point decrease. Accordingly, it is possible to specify the electric apparatus or part of the rails where the abnormality occurs based on a change in the signal level of the reflected wave observed.

A third aspect is the maintenance apparatus described above, in which the detection section detects the occurrence of abnormality using presence or absence of a previous reflected wave corresponding to the reflected wave received this time.

As a result, in some embodiments, it is possible to detect rail breakage as the abnormality. That is, when the rail breakage occurs, the pulse signal is reflected at an occurrence place of the rail breakage and is not propagated any farther, and thus no reflected wave is observed from connection points of all electric apparatuses connected to the rails beyond the occurrence place of the rail breakage. Accordingly, it is possible to detect the occurrence and the occurrence place of the rail breakage from the presence or absence of the reflected wave.

A fourth aspect is the maintenance apparatus described above, in which the observation history includes information related to a time duration between the transmission of the pulse signal and the observation of the reflected wave, and the detection section detects the occurrence of abnormality using a time duration between the pulse signal transmitted this time and the reflected wave received this time.

As a result, in some embodiments, it is possible to specify which connection point of the electric apparatus the observed reflected wave is from. This is because the time duration from the transmission of the pulse signal to the observation of the reflected wave by the connection point of the electric apparatus is determined according to a distance from the observation point to the connection point. Furthermore, when the reflected wave whose time duration does not correspond to any previous time durations included in the observation history is included in the reflected waves observed, this reflected wave can be determined as the reflected wave by the occurrence place of the rail breakage, for example. This is because generation of a new reflected wave implies the occurrence of the rail breakage.

A fifth aspect is the maintenance apparatus described above, in which the observation signal includes the reflected wave from the connection point to which the electric apparatus is connected, and the observation history includes information related to the time duration between the transmission of the pulse signal and the observation of the reflected wave, and the detection section determines at least a source of the abnormality using the signal level of the reflected wave, the presence or absence of the previous reflected wave corresponding to the reflected wave received this time, and the time duration between the pulse signal transmitted this time and the reflected wave received this time.

As a result, in some embodiments, it is possible to detect that the abnormality occurs in any one of the rails and the electric apparatus connected to the rails, and determine where in part of the rails or the electric apparatus the source of the abnormality is. That is, it is possible to specify which connection point of the electric apparatus the observed reflected wave is from based on the time durations included in the observation history. Then, it is possible to determine the electric apparatus or the part of the rails where the abnormality occurs from the signal level of the reflected wave. Furthermore, it is possible to determine the occurrence and the occurrence place of the rail breakage from the presence or absence of the reflected wave from the connection point of the electric apparatus.

A sixth aspect is the maintenance apparatus described above, in which the maintenance apparatus further includes a storage section that stores information on a relative connecting position of each electric apparatus including information on an inbound direction or an outbound direction as seen from the observation point in association with the time duration, and the detection section refers to storage content of the storage section to determine the source of the abnormality.

As a result, in some embodiments, it is possible to determine the source of the abnormality including distinguishment of whether the source is in the inbound direction or the outbound direction as seen from the observation point. That is, since the information on the relative connecting position of the each electric apparatus including the information on the inbound direction or the outbound direction as seen from the observation point is stored in association with the time duration between the transmission of the pulse signal and the observation of the reflected wave, it is possible to specify the direction of the rail, either in the inbound direction or the outbound direction, to which the connection point of the electric apparatus that the observed reflected wave is from is connected.

A seventh aspect is a maintenance system, in which a plurality of maintenance apparatuses described above are disposed along the rails, and the observation points of the plurality of maintenance apparatuses adjacent to each other are defined such that observation ranges observed by the observation sections partly overlap each other.

As a result, in some embodiments, it is possible to implement the maintenance system that exerts the aspect in any one of the first to sixth aspects for a wide range of a railroad track.

Preferred embodiment of the present disclosure is described below with reference to the drawings. The present disclosure is not limited by the embodiment described below, and embodiments to which the present disclosure is applicable are not limited to the following embodiment. In the drawings, identical elements are denoted with identical reference signs.

[System Configuration]

FIG. 1 is an application example of a maintenance system according to the present embodiment. As illustrated in FIG. 1, a maintenance system 1 according to the present embodiment is a system for detecting occurrence of abnormality in any one of rails R of a railroad and electric apparatuses 20 connected to the rails R, and includes a plurality of maintenance apparatuses 10 disposed along the rails R.

Each of the plurality of maintenance apparatuses 10 transmits a pulse signal from an observation point P that is a connection point with each of the rails R, and detects the occurrence of the abnormality in any one of the rails R and the electric apparatuses 20 connected to the rails R based on an observation signal that appears at the observation point P after the transmission of the pulse signal. The plurality of maintenance apparatuses 10 are disposed such that an observation range 12 that one of the plurality of maintenance apparatuses 10 can detect the abnormality partly overlaps the observation range 12 of another one of the plurality of maintenance apparatuses 10 adjacently disposed, so that the maintenance system 1, as a whole, can detect the occurrence of the abnormality in any one of the rails R and the electric apparatuses 20 connected to the rails R.

The observation range 12 of the maintenance apparatus 10 is a range along the rails R with the observation points P as bases, and is determined depending on a pulse width and a signal level of the pulse signal transmitted by the maintenance apparatus 10 to the rails R. That is, the pulse signal transmitted to each of the rails R attenuates according to a propagation distance, and as will be described later, since the maintenance apparatus 10 transmits the pulse signal to the rail R and observes a reflected wave of the pulse signal, the observation range 12 is defined to set the propagation distance such that an attenuation degree of the reflected wave to be observed is within a distinguishable range of the reflected wave.

Each of the electric apparatuses 20 is an apparatus that is connected to the rails R and included in an electric circuit, such as a transmitter/receiver of a track circuit for transmitting and receiving signal current to or from the rails R, or an impedance bond. The track circuit includes various types such as a track circuit for signal control in units of a block section, a short track circuit disposed on both ends of the block section and used for train detection in a check-in/check-out method, a track circuit disposed in a whole warning section of a railroad crossing gate for continuously detecting trains in the section, a track circuit for railroad crossing gate control such as electronic train detectors disposed at a start point and a stop point of the warning of the railroad crossing gate, or a track circuit for backup having a longer detection section compared with a detection section of the track circuit for the signal control. The impedance bond includes an impedance bond disposed at an insulation part that is a boundary of an insulated track circuit, an impedance bond for balancing disposed at predetermined intervals to suppress abnormal voltage between the rails of a railroad track where a non-insulated track circuit is disposed, an impedance bond for sucking up return current, or the like.

[Detection of Occurrence of Abnormality]

A method for detecting the occurrence of the abnormality by the maintenance apparatus 10 is described. FIGS. 2 to 6 referred to in the description below are simplified diagrams of FIG. 1. That is, in FIGS. 2 to 6, two rails R on right and left sides are shown as a single rail R altogether. In addition, FIGS. 2 to 6 are diagrams focusing on a single maintenance apparatus 10. However, other electric apparatuses 20 and other maintenance apparatuses 10 adjacent to the focused maintenance apparatus 10 are connected to the rails R in an inbound direction and an outbound direction as seen from the focused maintenance apparatus 10, although not illustrated.

Figure 2:
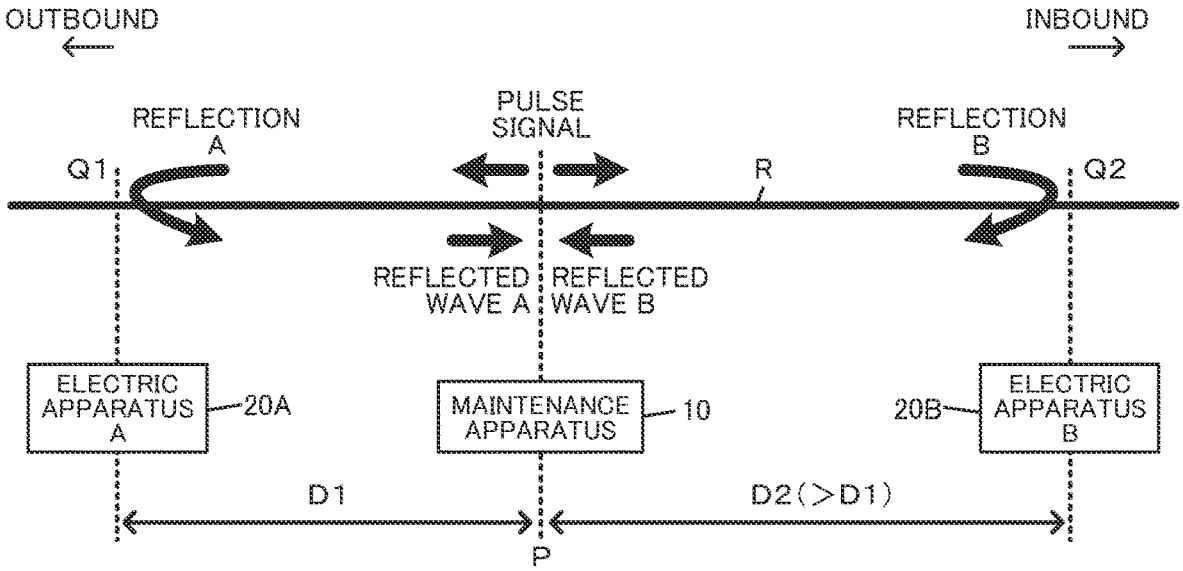
FIG. 2 is an example of an observation signal.
Figure 2:
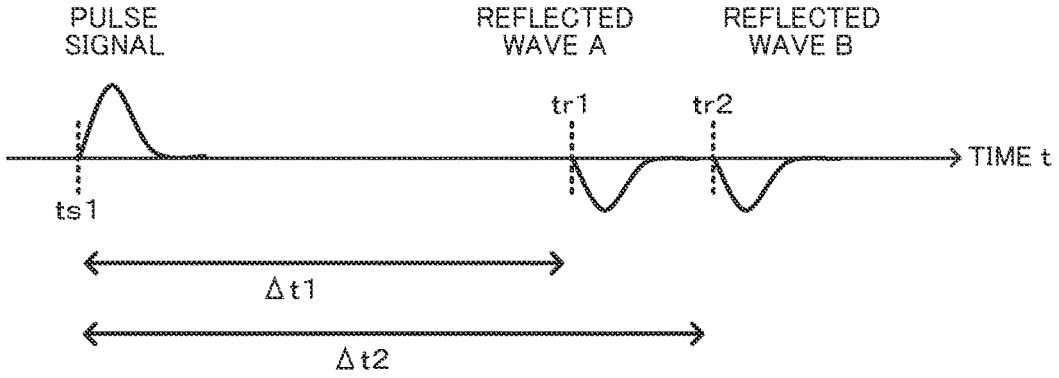

FIG. 2 illustrates an example where two electric apparatuses 20A and 20B are connected to the rails R. An upper side of a diagram illustrates a positional relationship among the maintenance apparatus 10 and the electric apparatuses 20A and 20B connected to the rails R, and a lower side illustrates an observation signal at the maintenance apparatus 10. The observation signal is illustrated with a horizontal axis representing a time t and a vertical axis representing a signal level. In the example in FIG. 2, the two electric apparatuses 20A and 20B are connected in different directions (in an inbound direction and an outbound direction) as seen from the maintenance apparatus 10.

The maintenance apparatus 10 transmits the pulse signal to each of the rails R from the observation point P that is the connection point with the rail R. The pulse signal transmitted to the rail R is propagated both in the inbound direction and the outbound direction by the rail R, and part of the pulse signal is reflected at a connection point Q (Q1 and Q2) with each of the electric apparatuses 20 and reaches the observation point P again. Part of the pulse signal not reflected at the connection point Q is continuously propagated by the rail R. After transmitting the pulse signal, the maintenance apparatus 10 observes the observation signal including the reflected wave from the connection point Q of the electric apparatus 20 as the observation signal that appears at the observation point P. An impedance of the electric apparatus 20 is connected in parallel with a characteristic impedance of the rail R as seen from the observation point P, and mismatching inevitably occurs at the connection point Q of the electric apparatus 20. Accordingly, a reflection coefficient determined by the characteristic impedance of the rail R and the impedance of the electric apparatus 20 becomes negative, and the reflected wave from the connection point Q of the electric apparatus 20 becomes a signal in an opposite phase with respect to the pulse signal.

In the example in FIG. 2, a distance D2 from the observation point P to the connection point Q2 of the electric apparatus 20B is longer than a distance D1 to the connection point Q1 of the electric apparatus 20A. Thus, as illustrated on the lower side of FIG. 2, when the maintenance apparatus 10 transmits the pulse signal from the observation point P at a time ts1, the maintenance apparatus 10 first observes the reflected wave from the connection point Q1 of the electric apparatus 20A at a time tr1, and then the reflected wave from the connection point Q2 of the electric apparatus 20B at a time tr2. A time duration Δt from the transmission of the pulse signal to the observation of the reflected wave at the observation point P is approximately in direct proportion to the distance D (D1 and D2) from the observation point P to the connection point Q of the electric apparatus 20 with the rail R. The time duration Δt can vary according to a change in leakage conductance in the rail R from the observation point P to the connection point Q. Accordingly, when the distance D from the observation point P to the connection point Q of the electric apparatus 20 is known, the maintenance apparatus 10 can specify which connection point Q of the electric apparatus 20 the reflected wave observed at the observation point P is from.

The abnormality detected by the maintenance apparatus 10 includes the abnormality in the electric apparatus 20 connected to the rails R and the abnormality in the rails R. The abnormality in the electric apparatus 20 in the former case includes: an open-circuit failure inside the electric apparatus 20 or an open-circuit failure in wiring between the electric apparatus 20 and the rails R; and a short-circuit failure inside the electric apparatus 20 or a short-circuit failure in the wiring between the electric apparatus 20 and the rails R. The abnormality in the rails R in the latter case includes an increase of the leakage conductance between the rails and ballast, and rail breakage. The observation signal observed by the maintenance apparatus 10 varies depending on the abnormality caused. The maintenance apparatus 10 compares the observation signal with an observation signal in a steady state without the abnormality so as to detect a source of the abnormality and content of the abnormality caused.

Figure 3:
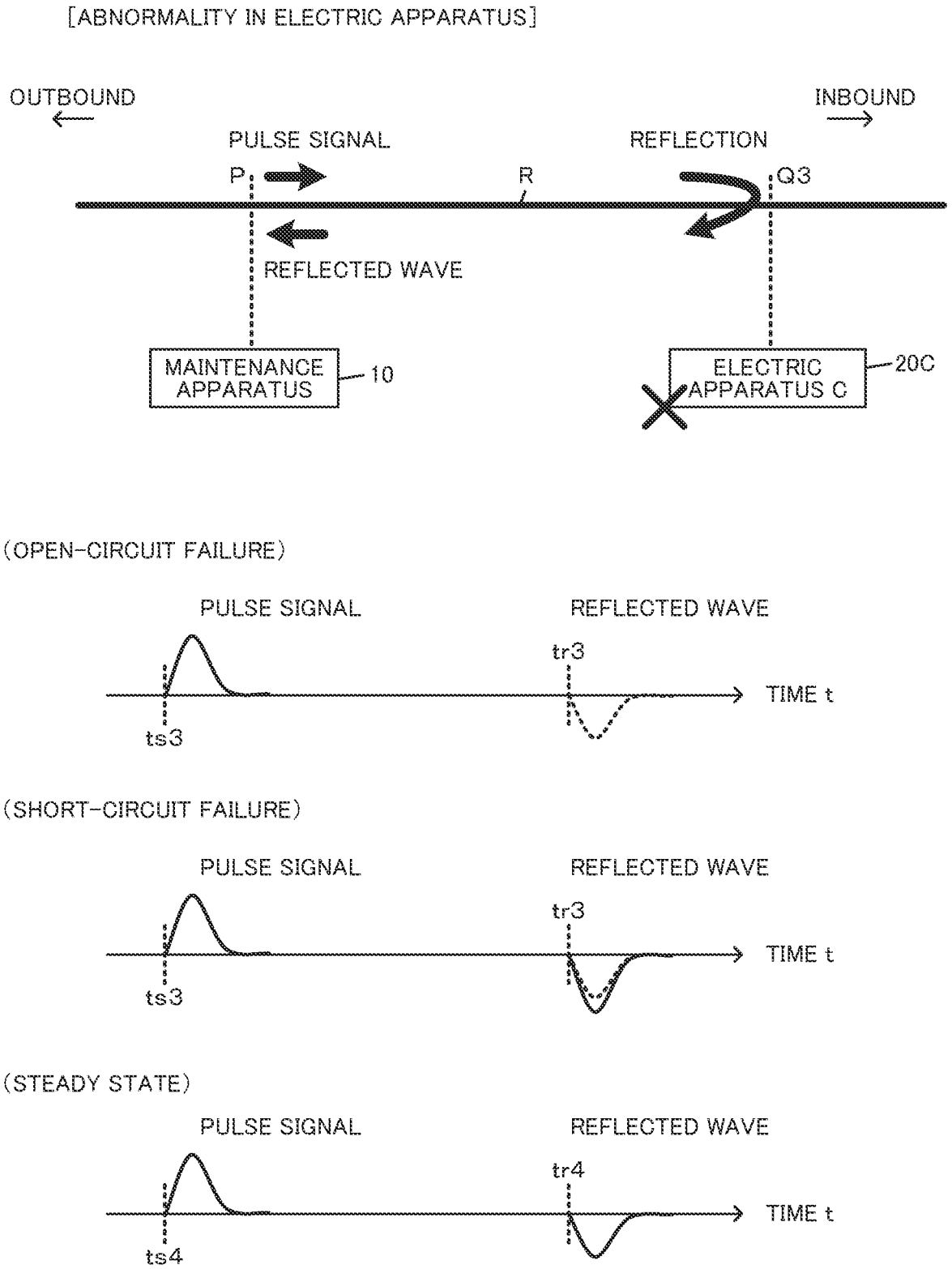
FIG. 3 is an example when abnormality in an electric apparatus occurs.

FIG. 3 is an example when the abnormality in the electric apparatus 20 occurs. In FIG. 3, an upper side of the drawing illustrates a positional relationship between the maintenance apparatus 10 and an electric apparatus 20C connected to the rails R, and a lower side illustrates observation signals at the maintenance apparatus 10. The observation signals show, from the top, an observation signal when the open-circuit failure occurs in the electric apparatus 20C, an observation signal when the short-circuit failure occurs in the electric apparatus 20C, and an observation signal in the steady state.

As illustrated in FIG. 3, when the abnormality occurs in the electric apparatus 20C, the signal level of the reflected wave from a connection point Q3 of the electric apparatus 20C observed at the observation point P varies. That is, when the open-circuit failure in the electric apparatus 20C occurs, the reflected wave is lost (not observed) compared with the steady state. This is because a load impedance at the connection point Q3 of the electric apparatus 20C as seen from the maintenance apparatus 10 changes from a load impedance corresponding to the electric apparatus 20C in the steady state to only the characteristic impedance of the rail R. Meanwhile, since the pulse signal is continuously propagated without being reflected at the connection point Q3, the reflected wave from the connection point Q of any other electric apparatus 20 connected beyond the connection point Q3 increases by an extent not attenuated at the connection point Q3, compared with the reflected wave in the steady state.

Furthermore, when the short-circuit failure in the electric apparatus 20C occurs, the reflected wave is in opposite phase having a reflection coefficient of "−1" with respect to the pulse signal, and the signal level of the reflected wave increases compared with the signal level in the steady state. This is because the short-circuit failure corresponds to a state where the impedance of the electric apparatus 20C as seen from the maintenance apparatus 10 is lost, and the load impedance at the connection point Q3 of the electric apparatus 20C is equivalent to zero. Meanwhile, when the short-circuit failure in the electric apparatus 20 occurs, the pulse signal is not propagated beyond the connection point Q3 of the electric apparatus 20, and thus the reflected wave from the connection point Q of any other electric apparatus 20 connected beyond the connection point Q3 is lost.

Accordingly, the maintenance apparatus 10 can detect the occurrence of the abnormality in the electric apparatus 20 by comparing the signal level of the observed reflected wave with the signal level in the steady state.

Furthermore, the abnormality in the electric apparatus 20 can include a failure other than the open-circuit failure and the short-circuit failure. In such a case, since the signal level of the observed reflected wave can vary depending on the content of the failure, the maintenance apparatus 10 can detect a possibility of the occurrence of some sort of abnormality in the electric apparatus. However, as will be described later, a decrease of the signal level of the reflected wave can also be caused by the abnormality in the rails R. In such a case, the maintenance apparatus 10 estimates and detects the source of the abnormality and the content of the abnormality based on a change in the signal level of the reflected wave from each of the connection points Q of the plurality of electric apparatuses 20.

Figure 4:
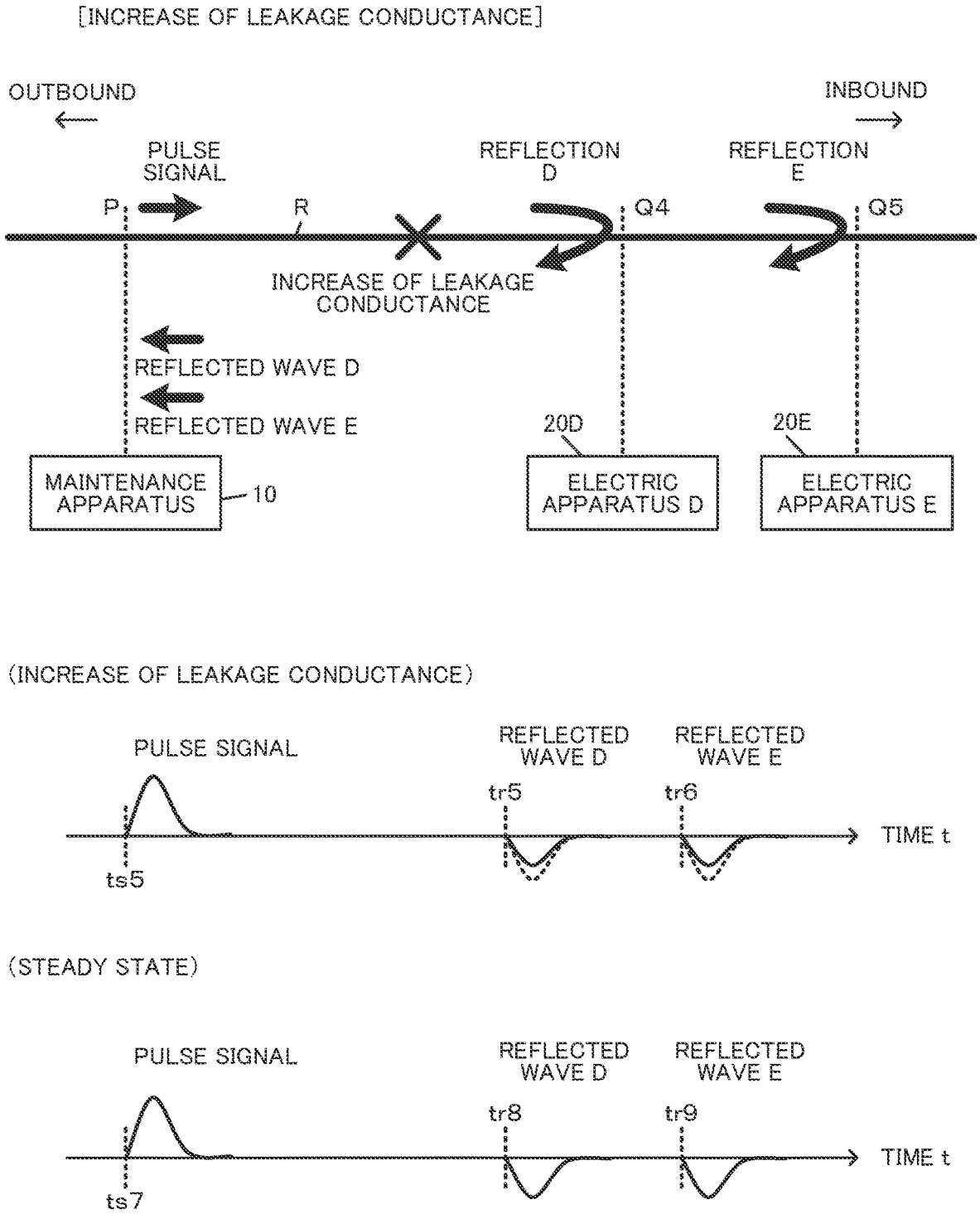
FIG. 4 is an example when an increase of leakage conductance occurs.

FIG. 4 is an example when an increase of the leakage conductance occurs as the abnormality in the rails R. In FIG. 4, an upper side of the drawing illustrates a positional relationship between the maintenance apparatus 10 and electric apparatuses 20D and 20E connected to the rails R, and a lower side illustrates observation signals at the maintenance apparatus 10. The observation signals show, from the top, an observation signal when the increase of the leakage conductance between at least one of the rails and the ballast occurs between the observation point P and a connection point Q4 of the electric apparatus 20D, and an observation signal in the steady state.

As illustrated in FIG. 4, when the increase of the leakage conductance occurs in the rail R between the observation point P and the connection point Q4 of the electric apparatus 20D, the signal levels of the reflected waves from the connection point Q4 of the electric apparatus 20D and a connection point Q5 of the electric apparatus 20E observed at the observation point P decrease compared with the signal levels in the steady state. This is because an increase of leakage conductance in the rail R is a state where leakage current increases, that is, a proportion of the leakage current in the pulse signal propagated by the rail R increases. Thus, the maintenance apparatus 10 can detect the occurrence of the increase of the leakage conductance in the rail R by comparing the signal level of the observed reflected wave with the signal level in the steady state.

Meanwhile, the signal level of the reflected wave from the connection point Q of the electric apparatus 20, observed at the observation point P, can also decrease due to the abnormality in the electric apparatus 20. As illustrated in the example of FIG. 4, when the plurality of electric apparatuses 20 are connected beyond an occurrence place of the increase of the leakage conductance as seen from the observation point P, it is possible to determine whether the decrease of the signal level of the observed reflected wave is caused by the increase of the leakage conductance in the rail R or the abnormality in any one of the plurality of electric apparatuses 20 by comparing the signal levels of the reflected waves from the respective connection points Q of the plurality of electric apparatuses 20. That is, this is because when the signal level of the reflected wave by the connection point Q4 of the electric apparatus 20D decreases due to the abnormality in the electric apparatus 20D, the signal level of the reflected wave from the connection point Q5 of the electric apparatus 20E connected beyond the electric apparatus 20D as seen from the observation point P barely changes unlike a case where the increase of the leakage conductance in the rail R occurs.

Figure 5:
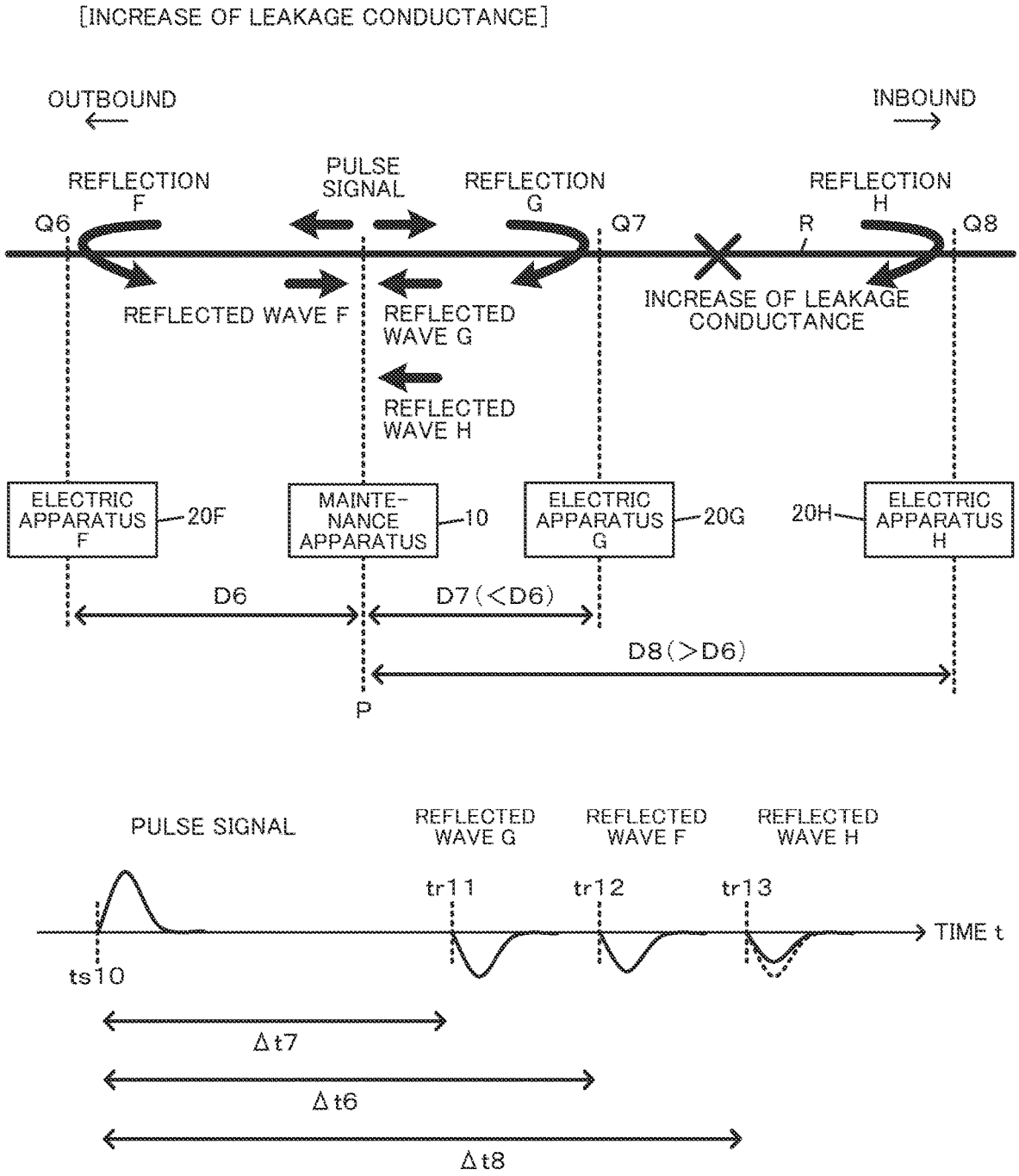
FIG. 5 is an example of the observation signal when the increase of the leakage conductance occurs.

The plurality of electric apparatuses 20 are connected to the rail R in the observation range 12 of the maintenance apparatus 10, and the occurrence place of the increase of the leakage conductance can be narrowed down based on the signal levels of the reflected waves from the connection points Q of the plurality of electric apparatuses 20. FIG. 5 is another example when the increase of the leakage conductance occurs as the abnormality in at least one of the rails R, and three electric apparatuses 20F, 20G, and 20H are connected to the rails R. In FIG. 5, an upper side of the drawing illustrates a positional relationship among the maintenance apparatus 10 and the electric apparatuses 20F, 20G, and 20H connected to the rails R, and a lower side illustrates an observation signal at the maintenance apparatus 10. In the example in FIG. 5, one of the electric apparatuses 20F is connected in the outbound direction seen from the maintenance apparatus 10, and two of the electric apparatuses 20G and 20H are connected in the inbound direction. The increase of the leakage conductance occurs in the rail R between connection points Q7 and Q8 of the electric apparatuses 20G and 20H in the inbound direction.

The pulse signal transmitted to the rail R from the observation point P by the maintenance apparatus 10 is propagated separately in the inbound direction and the outbound direction by the rail R, and part of the pulse signal becomes the leakage current when the pulse signal passes through the occurrence place of the increase of the leakage conductance. That is, as seen from the maintenance apparatus 10, all the signal levels of the reflected waves from positions beyond (positions farther than) the occurrence place of the increase of the leakage conductance decrease. In the example in FIG. 5, the signal level of the reflected wave from the connection point Q8 of the electric apparatus 20H decreases compared with the signal level in the steady state. On the other hand, the signal level of the reflected wave from a connection point Q6 of the electric apparatus 20F in the direction opposite to the occurrence place of the increase of the leakage conductance and the signal level of the reflected wave from the connection point Q7 of the electric apparatus 20G before the occurrence place of the increase of the leakage conductance barely change compared with the signal levels in the steady state. Accordingly, the maintenance apparatus 10 can detect the occurrence of the increase of the leakage conductance in the rail R by comparing the signal levels of the observed reflected waves with the signal levels in the steady state, and can narrow down the occurrence place of the increase of the leakage conductance in units such as between two adjacent connection points based on which connection point Q of the electric apparatus 20 out of the plurality of electric apparatuses 20 the reflected wave whose signal level changes is from compared with the signal level in the steady state.

Figure 6:
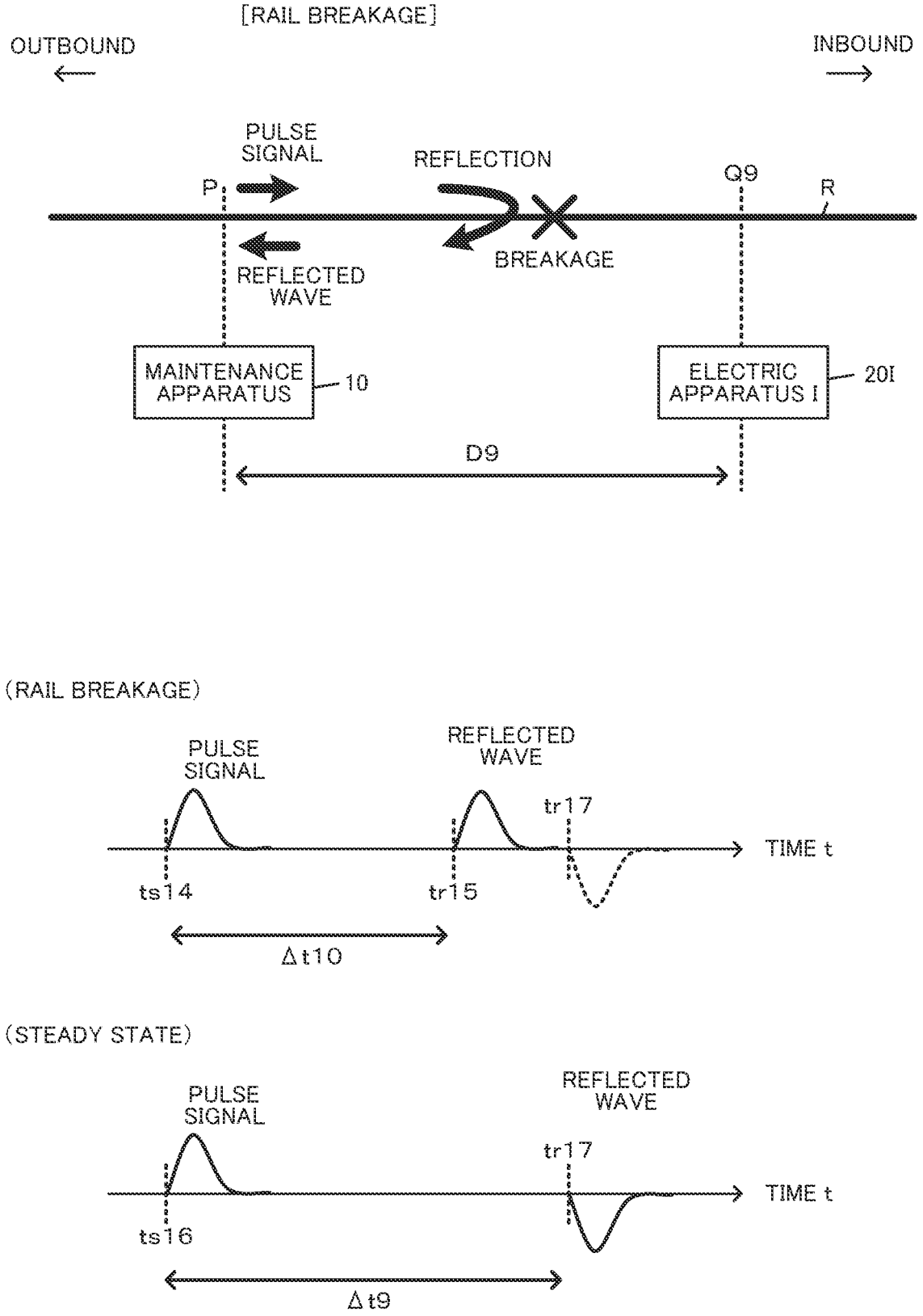
FIG. 6 is an example of the observation signal when rail breakage occurs.

FIG. 6 is an example when the rail breakage occurs as the abnormality in the rails R. In FIG. 6, an upper side of the drawing illustrates a positional relationship between the maintenance apparatus 10 and an electric apparatus 20I connected to the rails R, and a lower side illustrates observation signals at the maintenance apparatus 10. The observation signals show, from the top, an observation signal when the rail breakage occurs between the observation point P and a connection point Q9 of the electric apparatus 20I, and an observation signal in the steady state.

As illustrated in FIG. 6, when the breakage occurs in at least one of the rails R between the observation point P and the connection point Q9 of the electric apparatus 20I, the pulse signal transmitted from the observation point P to the rail R is reflected at an occurrence place of the rail breakage and is not propagated beyond the occurrence place. Accordingly, the maintenance apparatus 10 observes no reflected wave by the connection point Q9 of the electric apparatus 20I, but newly observes the reflected wave by the place of the rail breakage. This reflected wave is in phase with the pulse signal. A time duration Δt from the transmission of the pulse signal to the observation of the reflected wave by the occurrence place of the rail breakage is in direct proportion to a distance from the observation point P to the occurrence place of the rail breakage. Accordingly, the maintenance apparatus 10 can detect the occurrence of the rail breakage and specify the distance from the observation point P to the place of the rail breakage by comparing the time duration from the transmission of the pulse signal to the observation of the reflected wave with the time duration in the steady state. Furthermore, since the reflected wave from the connection point Q of any electric apparatus 20 connected beyond the occurrence place of the rail breakage as seen from the maintenance apparatus 10 is not observed, it is possible to specify in which direction's rail, in the inbound direction or the outbound direction, the rail breakage occurs based on from which connection point of the electric apparatus 20 the reflected wave is lost. Meanwhile, in a case of rail short-circuit due to an on-rail train, a reflected wave from a short-circuit portion is also observed. However, the reflected wave from the short-circuit portion in such a case is in opposite phase with respect to the pulse signal, so that it can be distinguished from the rail breakage.

[Functional Configuration of Maintenance Apparatus]

Figure 7:
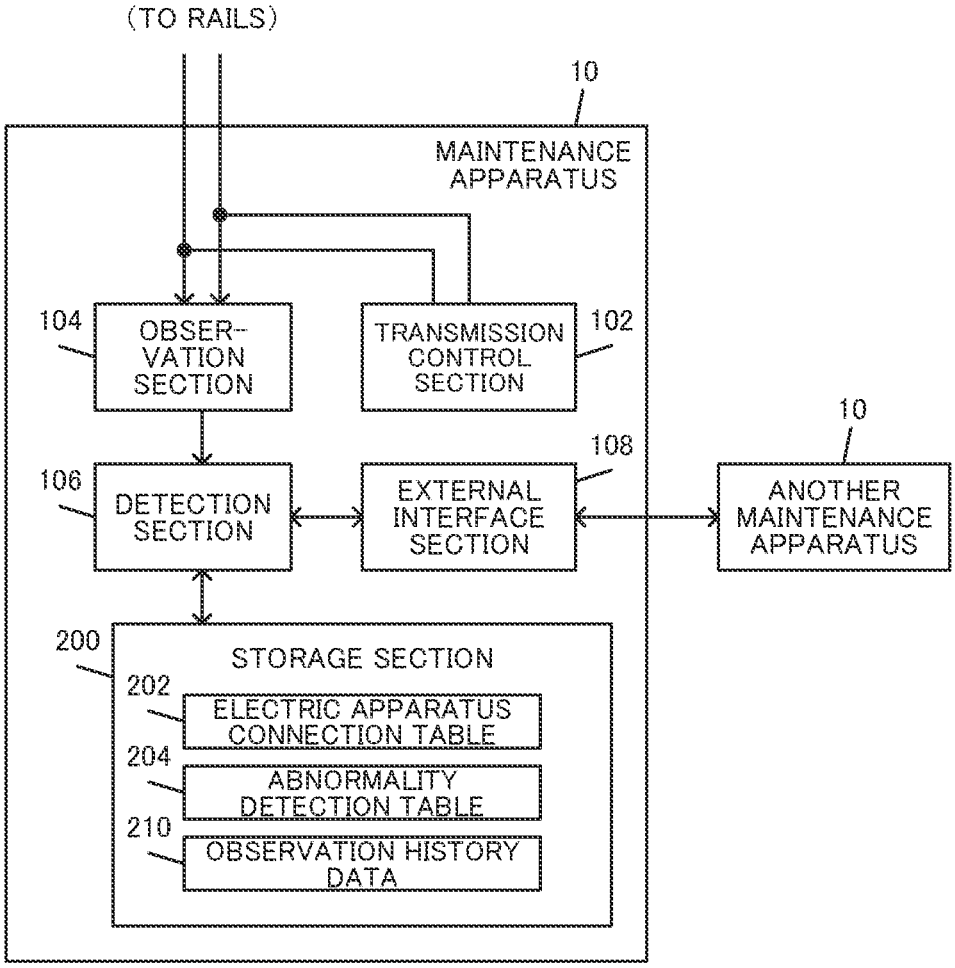
FIG. 7 is a functional configuration diagram of a maintenance apparatus.

FIG. 7 is a block diagram illustrating a functional configuration of the maintenance apparatus 10. According to FIG. 7, the maintenance apparatus 10 includes a transmission control section 102, an observation section 104, a detection section 106, an external interface section 108, and a storage section 200.

The transmission control section 102 transmits the pulse signal at predetermined transmission intervals from the predetermined observation point P on each of the rails R. A pulse wave can be generated, for example, by generating a sine wave signal having a predetermined frequency, a signal obtained by squaring this sine wave, a square wave signal, or a triangle wave signal, and extracting a signal waveform for a half cycle or one cycle of a waveform of the signal. The pulse wave is not limited to this, of course. In addition, the transmission interval between the pulse waves is set to be sufficiently longer than a time duration required for the reflected wave from an end of the observation range 12 of the maintenance apparatus 10 to reach the observation point.

The observation section 104 observes the observation signal that appears at the observation point after the transmission of the pulse signal by the transmission control section 102.

The detection section 106 compares an observation history of the observation signals observed by the observation section 104 with the observation signal received this time so as to detect the occurrence of the abnormality in any one of the rails R and the electric apparatuses 20 connected to the rails R. The detection section 106 detects the occurrence of the abnormality using the signal level of the reflected wave that is included in the observation signal and is from the connection point Q to which the electric apparatus 20 is connected. The detection section 106 also detects the occurrence of the abnormality using presence or absence of a previous reflected wave corresponding to the reflected wave received this time. The observation history includes information related to the time duration between the transmission of the pulse signal and the observation of the reflected wave. The detection section 106 detects the occurrence of the abnormality using a time duration between the pulse signal transmitted this time and the reflected wave received this time. The detection section 106 also determines the source of the abnormality.

In particular, a single observation includes receiving the observation signal between the transmission of the pulse signal and the next transmission of the pulse signal by the transmission control section 102, and the detection section 106 detects whether the abnormality occurs in any one of the rails R and the electric apparatuses 20 connected to the rails R in the observation range 12 based on the observation signal by the observation section 104 in each single observation. That is, the detection section 106 distinguishes the reflected waves included in the observation signal, and respectively specifies the reflected waves that correspond to the electric apparatuses 20 connected to the rails R in the observation range 12 in each single observation. Specifying the correspondence between the electric apparatus 20 and the reflected wave is performed by referring to an electric apparatus connection table 202 based on whether the time duration Δt from the transmission of the pulse signal to the observation of the reflected wave has a match.

FIG. 8 is an example of the electric apparatus connection table 202. According to FIG. 8, the electric apparatus connection table 202 stores, in association with an apparatus ID for identifying the electric apparatus 20, a connecting position with the rails R and an observation time duration for each of the electric apparatuses 20 connected to the rails R in the observation range 12 of the maintenance apparatus 10. The connecting position is a relative position with respect to the maintenance apparatus 10, and includes a connecting direction indicating the inbound direction or the outbound direction as seen from the maintenance apparatus 10, and the distance D along the rail from the observation point P of the maintenance apparatus 10. The observation time duration is the time duration from the transmission of the pulse signal from the observation point P to the observation of the reflected wave by the connection point Q of the electric apparatus 20. The time duration is determined from the distance D from the observation point P to the connection point Q and propagation speed Vp of the pulse signal or the reflected wave in the rail R. However, since the propagation speed Vp can vary due to the leakage conductance in the rail R, the time duration may be defined as a time range such as "X1 to X2" corresponding to a case where the leakage conductance is "0 to 0.01 [S/km]", for example. In FIG. 8, symbols are indicated instead of specific numerical values.

When the distinguished reflected waves include the reflected wave that is in phase with the pulse signal and does not correspond to any of the electric apparatuses 20, the detection section 106 detects the occurrence of the "rail breakage" as the abnormality. Then, the detection section 106 considers this reflected wave as the reflected wave from the occurrence place of the rail breakage, and calculates the distance from the observation point P to the occurrence place of the rail breakage based on the time duration Δt from the transmission of the pulse signal to the observation of the reflected wave. Then, the detection section 106 confirms presence or absence of the reflected wave from each of the connection points Q of the electric apparatuses 20 connected beyond a position corresponding to the calculated distance to the occurrence place of the rail breakage in both the inbound direction and the outbound direction so as to determine in which direction, in the outbound direction or the inbound direction as seen from the observation point P of the maintenance apparatus 10, the occurrence place of the rail breakage exists and specify the occurrence place of the rail breakage (see FIG. 6).

Furthermore, as for each of the electric apparatuses 20 having the corresponding reflected wave, the detection section 106 compares the signal level of the reflected wave with the signal level in the steady state so as to determine whether the abnormality occurs in the electric apparatus 20. That is, the detection section 106 refers to observation history data 210 that is the observation history of the observation signals so as to compare the signal level of the reflected wave observed this time with the signal level of the reflected wave that is detected from the previous reflected waves as being without the abnormality (normal) as the reflected wave in the steady state. Without a change in the signal level, the detection section 106 determines that the electric apparatus 20 is "without abnormality (normal)". With a change in the signal level, the detection section 106 determines the source of the abnormality and the content of the abnormality according to an abnormality detection table 204.

FIG. 9 is an example of the abnormality detection table 204. According to FIG. 9, the abnormality detection table 204 defines each of the abnormalities that occurs in the rails R or the electric apparatus 20 by associating a combination of the source and the content of the abnormality with the change in the signal level of the reflected wave to be observed when the relevant abnormality occurs.

For example, when the reflected wave from the connection point Q of a certain electric apparatus 20 is lost, the detection section 106 determines that the abnormality is the open-circuit failure in this electric apparatus 20. Furthermore, when the signal level of the reflected wave from the connection point Q of a certain electric apparatus 20 increases, the detection section 106 determines that the abnormality is any one of 1) the short-circuit failure in this electric apparatus 20, 2) a failure that is other than the open-circuit failure and the short-circuit failure and can reduce the impedance of this electric apparatus 20, and 3) a decrease of the leakage conductance in the rail before the electric apparatus 20 as seen from the observation point P. In this case, the detection section 106 further refers to the signal levels of the reflected waves from other electric apparatuses 20 connected beyond the electric apparatus 20. Then, the detection section 106 determines that the abnormality is 1) the short-circuit failure when the signal levels are lost, 2) the failure that can reduce the impedance when the signal levels barely change or increase, or 3) the decrease of the leakage conductance when all the signal levels decrease. Furthermore, when the signal level of the reflected wave from the connection point Q of a certain electric apparatus 20 decreases compared with the signal level in the steady state, the detection section 106 determines that the abnormality is 1) the increase of the leakage conductance in the rail before this electric apparatus 20 as seen from the observation point P, or 2) a failure in this electric apparatus 20 (a failure that is other than the open-circuit failure and the short-circuit failure and can increase the impedance of the electric apparatus 20). In this case, the detection section 106 further refers to the signal levels of the reflected waves from other electric apparatuses 20 connected beyond the electric apparatus 20. Then, the detection section 106 determines that the abnormality is 1) the increase of the leakage conductance when all the signal levels decrease, or 2) the failure in the electric apparatus 20 when the signal levels barely change.

Accordingly, the detection section 106 narrows down and detects the source and the content of the abnormality such as which of the rails R and the electric apparatuses 20 connected to the rails R has the abnormality and what kind of abnormality occurs based on a combination of the signal levels of the reflected waves from the connection points Q of the plurality of the electric apparatuses 20 connected to the rails R in the observation range 12.

A detection result by the detection section 106 is included and stored in the observation history data 210. FIG. 10 is an example of the observation history data 210. According to FIG. 10, the observation history data 210 is generated for each single observation, and stores, in association with an observation ID 212 for identifying the observation, a pulse signal transmission time 214 by the transmission control section 102, observation signal waveform data 216 by the observation section 104, reflected wave data 218 included in the observation signal, and detection result data 220 of the abnormality. The reflected wave data 218 and the detection result data 220 are data calculated by the detection section 106. The reflected wave data 218 stores, in association with a reflected wave ID for identifying the reflected wave, the time duration from the transmission of the pulse signal to the observation of this reflected wave and the signal level for each reflected wave included in the observation signal. The detection result data 220 stores the detection result of the abnormality in association with each combination of the corresponding reflected wave (the reflected wave ID) and electric apparatus (the apparatus ID). The combination includes a combination missing a corresponding counterpart.

The external interface section 108 is implemented by a communication device such as a communication module that performs wired or radio communication via a given communication network or a relay for external output, for example, to output and input data to and from an external apparatus such as another maintenance apparatus 10.

The storage section 200 is implemented by a storage device such as a hard disk, a read only memory (ROM), or a random access memory (RAM). According to the present embodiment, the storage section 200 stores the electric apparatus connection table 202, the abnormality detection table 204, and the observation history data 210.

[Advantageous Effects]

As described above, according to the present embodiment, the occurrence of the abnormality in any one of the rails R and the electric apparatuses 20 connected to the rails R can be detected. The maintenance apparatus 10 transmits the pulse signal to each of the rails R from the observation point P, and observes the observation signal that appears at the observation point P. However, when the abnormality occurs in any one of the rails R and the electric apparatuses 20 connected to the rails R, the observation signal can vary. Accordingly, the observation signal is compared, for example, with the observation history that is the previous observation signal in a normal state of the rails R and the electric apparatuses 20 connected to the rails R, so that the occurrence of the abnormality in any one of the rails R and the electric apparatuses 20 connected to the rails R can be detected.

Note that applicable embodiments of the present disclosure are not limited to the embodiment described above, and that the foregoing embodiment can be modified as appropriate without deviating from the scope of the present disclosure.

For example, according to the embodiment described above, the maintenance apparatus 10 determines the source of the abnormality such as where in the rails R and the electric apparatuses 20 connected to the rails R the abnormality occurs and the content of the abnormality caused. However, when only the detection of the source is required and report of the content of the abnormality is not required, the maintenance apparatus may determine only the source of the abnormality. Furthermore, the maintenance apparatus may detect the occurrence of the abnormality in any one of the electric apparatuses 20 when the signal level of the reflected wave serving as the observation signal changes larger than a threshold compared with the signal level in the steady state. Alternatively, the maintenance apparatus may detect an indication of the abnormality in the electric apparatus when the change in the signal level is equal to or smaller than the threshold compared with the signal level in the steady state, but the signal level is continuously changing. For example, a continuous decrease of the signal level can be considered as the indication of the improper dropping due to the increase of the leakage conductance.

Although only some embodiments of the present invention have been described in detail above, those skilled in the art will readily appreciate that many modifications are possible in the embodiments without materially departing from the novel teachings and advantages of this invention. Accordingly, all such modifications are intended to be included within scope of this invention.

What is claimed is:

1. A maintenance apparatus comprising:

a transmission control section that transmits a pulse signal from a predetermined observation point of rails of a railroad;

an observation section that observes an observation signal that appears at the observation point after transmission of the pulse signal;

a detection section that compares an observation history of the observation signals and the observation signal received this time to detect occurrence of abnormality in any one of the rails and at least one electric apparatus connected to the rails; and a storage section that stores the connection position of the electric apparatus and direction of the electric apparatus on the rails from the observation point, wherein:

the observation signal includes a reflected wave from a connection point to which the electric apparatus is connected, the detection section determines whether a decrease of signal level of the reflected wave, included in the observation signal received this time, satisfies a condition that all the reflected waves from the connection positions beyond the point where an increase of leakage conductance between the rail and ballast is observed, as seen from the observation point, are the decrease of the signal level of the reflected waves, by referring to the stored contents of the storage section, in comparing the observation history of the observation signals and the observation signal received this time, and the detection section determines the presence of the increase of leakage conductance and narrows down the occurrence location of the increase of leakage conductance.

2. The maintenance apparatus as defined in claim 1, wherein the detection section detects the occurrence of abnormality using presence or absence of a previous reflected wave corresponding to the reflected wave received this time.

3. The maintenance apparatus as defined in claim 1, wherein the observation history includes information related to a time duration between the transmission of the pulse signal and observation of the reflected wave, and the detection section detects the occurrence of abnormality using a time duration between the pulse signal transmitted this time and the reflected wave received this time.

4. The maintenance apparatus as defined in claim 1, wherein the observation history includes a record of the transmitted pulse signals, the received reflected waves corresponding to the transmitted pulse signals, and a time duration between the transmitted pulse signals and the received reflected waves, and the detection section determines at least a source of the abnormality using a signal level of a currently received reflected wave, presence or absence of a previously received reflected wave in the received waves recorded in the observation history that matches to the currently received reflected wave, and a time duration between the currently transmitted pulse signal and the currently received reflected wave received this time.

5. The maintenance apparatus as defined in claim 4, wherein the storage section stores the connection position of the electric apparatus and the direction of the electric apparatus in association with the time duration, and the detection section refers to storage content of the storage section to determine the source of the abnormality.

6. A maintenance system wherein a plurality of maintenance apparatuses defined in claim 1 are disposed along the rails, and the observation points of the plurality of maintenance apparatuses adjacent to each other are defined such that observation ranges observed by the observation sections partly overlap each other.

7. A maintenance method comprising:

transmitting a pulse signal from a predetermined observation point of rails of a railroad;

observing an observation signal that appears at the observation point after transmission of the pulse signal;

detecting occurrence of abnormality in any one of the rails and at least one electric apparatus connected to the rails by comparing an observation history of the observation signals and the observation signal received this time; and storing the connection position of the electric apparatus and direction of the electric apparatus on the rails from the observation point, wherein:

the observation signal includes a reflected wave from a connection point to which the electric apparatus is connected, and detecting the occurrence of abnormality comprises determining whether a decrease of signal level of the reflected wave, included in the observation signal received this time, satisfies a condition that all the reflected waves from the connection positions beyond the point where an increase of leakage conductance between the rail and ballast is observed, as seen from the observation point, are the decrease of the signal level of the reflected waves, by referring to the stored contents of the storage section, in comparing the observation history of the observation signals and the observation signal received this time, and determining the presence of the increase of leakage conductance and narrows down the occurrence location of the increase of leakage conductance.

* * * * *